United States Patent [19]

Lischewski et al.

[11] 4,419,431

[45] Dec. 6, 1983

[54] ONE- OR TWO-COMPONENT DIAZO-TYPE MATERIAL WITH DIPHENYL DIAMINE AS LIGHT FADE INHIBITOR

[75] Inventors: Regina, Lischewski, Wolfen; Jörg Marx, Dessau; Reinhard Walter, Wolfen; Peter Möckel, Lützschena, all of German Democratic Rep.

[73] Assignee: VEB Filmfabrik Wolfen, Wolfen, German Democratic Rep.

[21] Appl. No.: 326,099

[22] Filed: Nov. 30, 1981

[51] Int. Cl.[3] ..... G03C 1/60

[52] U.S. Cl. ..... 430/179; 430/146; 430/171; 430/372; 430/519; 430/561

[58] Field of Search ..... 430/179, 181, 372, 484, 430/518, 519, 561, 146, 171

[56] References Cited

U.S. PATENT DOCUMENTS

| | | | |
|---|---|---|---|
| 2,990,281 | 6/1961 | Printy et al. | 430/176 |
| 3,336,135 | 8/1967 | Terashima et al. | 430/372 |
| 3,704,129 | 11/1972 | de Boer et al. | 430/173 |
| 3,716,364 | 2/1973 | Gogola | 430/181 |
| 3,857,896 | 12/1974 | Desjarlais | 430/181 |

FOREIGN PATENT DOCUMENTS

| | | | |
|---|---|---|---|
| 136412 | 5/1970 | Czechoslovakia | 430/179 |

OTHER PUBLICATIONS

Chemical Abstracts, vol. 74, #149245u, 1971.

*Primary Examiner*—Charles L. Bowers, Jr.
*Attorney, Agent, or Firm*—Jordan and Hamburg

[57] ABSTRACT

This invention relates to a one- or two-component diazo-type material with improved light stability and duplication capabilities. This is accomplished by using compounds of the general formula

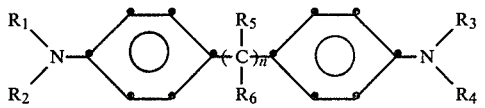

(I)

or

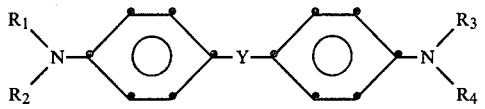

(II)

wherein $R_1$, $R_2$, $R_3$, $R_4$ being the same or different, represent hydrogen, alkyl with 1 to 5 carbon atoms, $R_1$ and $R_2$ and/or $R_3$ and $R_4$ represent the alkyl groups necessary for completion of a 5- or 6-membered heterocyclic ring, wherein the ring may comprise a further hetero atom, such as N, O or S;

$R_5$, $R_6$ being the same or different, represent hydrogen, aryl, alkyl with 1 to 4 carbon atoms;

Y represents —S—, —SO—, —$SO_2$—; and n is 0, 1, 2, 3, which are added to the material as fading inhibitors. These compounds can be easily synthesized and are compatible with the system, having an absorption maximum below 380 nm and reduced fogging tendency. They may also be employed in the form of their hydro salts.

15 Claims, No Drawings

ONE- OR TWO-COMPONENT DIAZO-TYPE MATERIAL WITH DIPHENYL DIAMINE AS LIGHT FADE INHIBITOR

BACKGROUND OF THE INVENTION AND PRIOR ART STATEMENT

This invention relates to a diazo-type material, which may be a one- or two-component material.

Diazo-type materials are subject to high loads by light during their use in reading apparatuses. For this reason, light stability of the image dyestuffs for a diazo material is an important criterion. At the same time, all other qualities of the system, such as thermal stability, light sensitivity, coupling kinetics and absorption behavior need to be optimally ensured.

A higher light stability of the dyestuffs may, for instance, be achieved through suitable substitution of the diazonium components and coupler. Here, however, the expenses involved with synthesis for manufacturing suitable components are very high, while efficiency, i.e. prevention of fading of the dyestuffs, is very low. Patent Nos. DE-PS 697 051, DE-PS 8 386 92 and DE-PS 8 649 51 describe azo dyestuffs as image dyestuffs for diazo-type materials which have been made light-fast through an altered molecular arrangement. It is easier to add substances to an established diazo system which prevent fading of the image dyestuffs in reading apparatuses or at least retard it.

Besides the improvement in light stability, other supplemental factors, such as system compatibility, reduced fogging tendency, ease of synthesis and short-waved absorption of the inhibitor, still need to be fulfilled.

The compounds and classes of compounds known in the prior art, such as sterically hindered phenols (DE-PS No. 1 772 981) and ethylene diamine compounds (DE-AS No. 1 797 322) as well as 3-anilino-pyrazole (DD-WP No. G 03 C/221 629), considering the relatively high expenses that have to be incurred with their synthesization, do not result in a correspondingly high improvement in light-fastness of the azo dyes. A favorable effect against the fading rate of dyestuffs has been achieved with phosphoric-acid-ester-anilides (DD-WP No. G 03 C/222 062) which are relatively easy to prepare. The range of their absorption maximum, however, lies to far in the diazonium salt band. This makes the duplication process harder.

The object of this invention is to improve light stability in diazo-type materials under the conditions present in reading apparatuses.

The light-protective substances known and used up to now have either low efficiency or do not, or only inadequately fulfill certain supplemental requirements, for instance suitability for defect-free duplication.

SUMMARY OF THE INVENTION

It is the object of the present invention to create fading inhibitors which, being sufficiently effective, can be easily synthesized and, in addition to good compatibility with the system, have an absorption maximum under 380 nm and reduced fogging tendency. According to this invention, this object is accomplished by providing a one- or two-component diazo-type material with fading inhibitors which contains a compound of the general formula

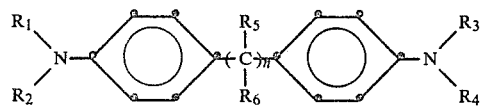

(I)

or

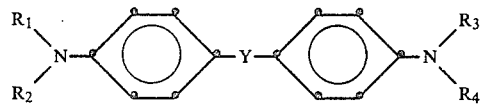

(II)

wherein $R_1$, $R_2$, $R_3$, $R_4$ being the same or different, represent hydrogen, alkyl with 1 to 5 atoms of carbon, $R_1$ and $R_2$ and/or $R_3$ and $R_4$ represent the alkyl groups necessary for completion of a 5- or 6-membered heterocyclic ring, wherein the ring may have a further hetero atom, such as N, O or S;

$R_5$, $R_6$ being the same or different, represent hydrogen, aryl, alkyl with 1 to 4 carbon atoms;

Y represents —S—, —SO—, —$SO_2$—; and n is 0, 1, 2, 3.

If desired, such compounds may be employed in the form of their hydro salts, such as hydrochloride, hydriodide or hydrotosylate.

DETAILED DESCRIPTION OF PREFERRED EMBODIMENTS

This compound is present in an amount sufficient to increase light stability of azo image dyestuff formed by light imaging and development of said material.

These substances have a good compatibility with the system and are chemically inert in the presence of other components of the diazo system. In addition to their high effectiveness and the concomitantly connected visible improvement in light stability of the azo dyestuffs, these compounds exhibit a suitable absorption pattern. The tendency to form dyes at illuminated spots (fogging) is very small, which constitutes another advantage. The proposed substances are, furthermore, easy to synthesize. They are produced by the generally known condensation process of substituted amines with carbonyl compounds, sulfur chlorides or sulfur oxychlorides.

EXAMPLE 1

A diazo system of the following composition is introduced in 1000 ml of a 7.5% cellulose acetate solution in $CH_2Cl_2/CH_3OH$. This is cast on a base of about 10–15 $m^2$ polyethylene terephthalate whereby a transparent film is produced.

8 g: 2,5-dibutoxy-4-morpholino-benzene-diazoniumtetrafluoroborate
4.8 g: 2-hydroxy-3-naphthoic acid-2-methoxy-anilide
3.2 g: resorcinol
12 g: N,N-tetramethyl-diaminodiphenylmethane
36 g: p-toluene sulfonic acid After illumination, the image dyestuff is developed through a basic medium. Improvement in light stability after a five-hour irradiation is 380% as compared to the same layer formation without an inhibitor.

EXAMPLE 2

A glass plate of 10 $cm^2$ is coated with a 10% acetylcellulose solution which has the following components of a diazo system:

60 mg: 2,5-diethoxy-4-morpholino-benzene-diazonium-tetrachlorozincate
40 mg: cyanoacetic acid morpholide
30 mg: 2-hydroxy-3-naphthoic acid-2-methoxy-anilide
100 mg: N,N-tetramethyldiaminodiphenyl
120 mg: sulfosalicylic acid After illumination the image dyestuff is developed through a basic medium. Light-fastness of the image dyestuff increases by 330%.

EXAMPLE 3

A diazo system with the following composition is introduced into 1000 ml cellulose butyrate solution in $CH_2Cl_2$/acetone, which is cast on a surface of 10 to 15 $m^2$, creating a transparent film:

10 g: 2,5-dibutoxy-4-morpholino-benzene-diazoniumtetrachloro zincate
5.2 g: 2,3-dihydroxynaphthaline
3.6 g: aceto acetanilide
8 g: N,N-tetramethyl-diaminodiphenylmethane hydrochloride
3.5 g: p-toluene sulfonic acid.

After illumination, the image dyestuff is developed through a basic medium. Improvement in light stability through such addition is about 360%.

EXAMPLE 4

A diazo system with the following composition is added to 1000 ml of an 8% polystyrene solution in acetone, which is cast onto a white opaque paper base:

8 g: p-N,N-diethylamino-benzene-diazonium tetrafluoroborate
5.2 g: β-naphthol
3.2 g: aceto acetanilide
10 g: N,N-tetramethyldiaminodiphenylsulfone
5 g: sulfosalicylic acid.

After illumination, the image dyestuff is developed through a basic medium. Improvement in light-fastness by means of this inhibitor is about 200%.

EXAMPLE 5

As in Example 1, with the exception that bis-[4-methylethyl-aminophenyl] methane is employed, instead of N,N-tetramethyl-diamino-phenylmethane. Improvement in light stability after a 5-hour irradiation is 250%, as compared with the same coating composition without an inhibitor.

EXAMPLE 6

As in Example 1, with the exception that N,N-methylethyl-N'-propyl-4-diaminodiphenylmethane is employed, instead of N,N-tetramethyl-diaminodiphenylmethane. Improvement in light stability after a 5-hour irradiation is 200% as compared with the same coating composition without an inhibitor.

We claim:

1. A one- or two-component diazo-type composition with a fading inhibitor, comprising a light-sensitive diazonium compound, and a compound of the general formula

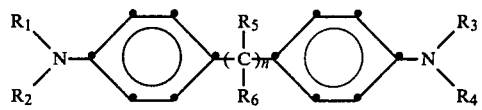

(I)

or

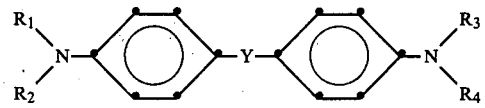

(II)

having a light absorption maximum less than about 380 nm, wherein $R_1$, $R_2$, $R_3$, $R_4$ being the same or different, represent hydrogen, alkyl with 1 to 5 carbon atoms, $R_1$ and $R_2$ and/or $R_3$ and $R_4$ represent the alkyl groups necessary for completion of a 5- or 6-membered heterocyclic ring, with or without another hetero atom of N, O or S;

$R_5$, $R_6$ being the same or different, represent hydrogen, aryl, alkyl with 1 to 4 carbon atoms;

Y represents —S—, —SO—, —$SO_2$—; and n is 0, 1, 2, 3;

as the inhibitor in an amount sufficient to increase light stability of azo image dyestuff formed by light imaging and development of said composition.

2. The composition of claim 1 wherein said inhibitor is a hydro salt of the compound of formula (I) or (II).

3. The composition of claim 1 wherein said inhibitor is N,N-tetramethyldiaminodiphenylmethane.

4. The composition of claim 1 wherein said inhibitor is N,N-tetramethyldiaminodiphenyl.

5. The composition of claim 2 wherein said inhibitor is N,N-tetramethyl-diaminodiphenylmethane hydrochloride.

6. The composition of claim 1 wherein said inhibitor is N,N-tetramethyldiaminodiphenylsulfone.

7. The composition of claim 1 wherein said inhibitor is bis-(4-methylethylaminophenyl) methane.

8. The composition of claim 1 wherein said inhibitor is N,N-methylethyl-N'-propyl-4-diamino diphenylmethane.

9. A one or two-component diazo-type material comprising the composition of claim 1 together with a support therefor.

10. The composition of claim 3 wherein said light sensitive diazonium compound is 2,5-dibutoxy-4-morpholinobenzene-diazonium tetrafluoroborate.

11. The composition of claim 4 wherein said light sensitive diazonium compound is 2,5-diethoxy-4-morpholinobenzene-diazonium tetrachlorozincate.

12. The composition of claim 5 wherein said light sensitive diazonium compound is 2,5-dibutoxy-4-morpholinobenzene-diazonium tetrachlorozincate.

13. The composition of claim 6 wherein said light-sensitive diazonium compound is p-N,N-diethylamino-benzene-diazonium tetrafluoroborate.

14. The composition of claim 7 wherein said light sensitive diazonium compound is 2,5-dibutoxy-4-morpholinobenzene-diazonium tetra-fluoroborate.

15. The composition of claim 8 wherein said light sensitive diazonium compound is 2,5-dibutoxy-4-morpholinobenzene-diazonium tetrafluoroborate.

* * * * *